US006101779A

United States Patent [19]

Davenport

[11] Patent Number: 6,101,779

[45] Date of Patent: Aug. 15, 2000

[54] CONSTRUCTION UNIT FOR A MODULAR BUILDING

[75] Inventor: Gary A. Davenport, Atlanta, Ga.

[73] Assignee: Space Master Building Systems, LLC, Atlanta, Ga.

[21] Appl. No.: 09/082,248

[22] Filed: May 20, 1998

[51] Int. Cl.[7] ..... E04B 5/04

[52] U.S. Cl. ..... 52/602; 52/601; 52/223.6; 52/309.12; 52/309.17

[58] Field of Search ..... 52/602, 601, 223.6, 52/234, 309.16, 309.17, 309.12, 600, 79.1

[56] References Cited

U.S. PATENT DOCUMENTS

| | | | |
|---|---|---|---|
| 973,165 | 10/1910 | Cahill | 52/600 |
| 2,039,183 | 4/1936 | Nagel | 52/600 |
| 3,811,722 | 5/1974 | Jones . | |
| 3,918,222 | 11/1975 | Bahramian . | |
| 4,067,158 | 1/1978 | Lawrence . | |
| 4,096,675 | 6/1978 | Howard et al. . | |
| 4,200,305 | 4/1980 | Eubank . | |
| 4,211,043 | 7/1980 | Coday . | |
| 4,236,361 | 12/1980 | Boden . | |
| 4,372,906 | 2/1983 | del Valle . | |
| 4,545,169 | 10/1985 | Rizk . | |
| 4,575,984 | 3/1986 | Versteeg | 52/601 |
| 4,751,803 | 6/1988 | Zimmerman . | |
| 4,942,707 | 7/1990 | Huettemann | 52/602 |
| 5,113,625 | 5/1992 | Davis . | |
| 5,201,546 | 4/1993 | Lindsay . | |
| 5,488,809 | 2/1996 | Lindsay . | |
| 5,493,836 | 2/1996 | Lopez-Muñoz . | |
| 5,493,838 | 2/1996 | Ross . | |
| 5,509,243 | 4/1996 | Bettigole et al. . | |

FOREIGN PATENT DOCUMENTS

| | | | |
|---|---|---|---|
| 497564 | 12/1919 | France | 52/602 |
| 4-124349 | 4/1992 | Japan | 52/600 |
| 4-221146 | 8/1992 | Japan | 52/600 |

OTHER PUBLICATIONS

*Insteel 3–D Panel System,* Insteel Construction Systems, Inc., Brunswick, Georgia unknown date.

*Primary Examiner*—Carl D. Friedman
*Assistant Examiner*—Dennis L. Dorsey
*Attorney, Agent, or Firm*—Morris, Manning & Martin; John R. Harris

[57] ABSTRACT

A supporting structure for modular building units comprising a pre-cast reinforced pre-insulated concrete slab. The supporting structure is a rectangular multi-bayed structural unit, suitable for use as a floor system or a roof, supported by composite pre-cast concrete beams integrated from the upper surface to the lower surface of the unit. At least a pair of pre-cast reinforced longitudinal beams run parallel to the length of the structure. Pre-cast reinforced composite cross-beams or purlins run in the transverse direction at regular intervals. The beams and purlins have integrated deformed reinforcing bar steel, and may include steel channel bottom reinforcement. An upper reinforcement of wire mesh is provided near the surface, welded to the reinforcing rods at intervals. The steel channel bottom reinforcement includes a plurality of spaced apart upright steel studs welded at regular intervals along the channel. In one embodiment, the beams and purlins create a series of structural recessed bays along the underside of the structure that include rigid polystyrene insulating foam for thermal and sound insulation as well as integral vapor barrier. In another, lower weight embodiment, a nonconcrete central foam core is provided, with a metal wire grid supported on each side of the foam core, with pre-cast perimeter beams and purlins.

38 Claims, 8 Drawing Sheets

PAD BLOCK

CONSTRUCTION UNIT FOR A MODULAR BUILDING

TECHNICAL FIELD

The present invention relates generally to modular buildings, and more specifically relates to a prefabricated construction unit that is suitable for use as a floor, wall, and/or roof of a modular building and can be easily transported to a building site.

BACKGROUND OF THE INVENTION

Modular buildings have become increasingly popular in high-growth areas of the country for various purposes. Rapidly expanding school districts often employ modular buildings, especially trailer-type buildings, for temporary classrooms. Prisons employ modular buildings to house inmates in an overflow situation. Expanding businesses often use modular buildings to provide temporary office space. Modular buildings are also employed as temporary housing in disaster areas.

Recently, there has been increased demand for more substantial construction in modular buildings. High density applications suggest the desirability for multi-level or storied modular buildings. Prison population overflow situations in particular require sturdier and more secure construction so as to deter vandalism and escape. In some applications, modular buildings become permanent by design due to speed of construction. In other cases, modular buildings become permanent by default, as when budgetary and other pressures on an institution (such as a school district) preclude further outlays for new facilities.

In order to be readily transportable, a prefabricated modular building construction component such as a floor or roof must be sized so that it can be transported along a highway. Furthermore, it must not be so heavy that it cannot be handled by conventional diesel-powered semi-tractors and moved as relatively conventional freight. However, the competing requirements of size and weight versus strength and durability has led to a number of undesirable compromises in the construction of modular buildings.

One example of a modular building is shown in U.S. Pat. No. 5,113,625 to Davis. A modular building constructed in accordance with this patent includes a support frame with a connected concrete pan which allows a concrete floor to be directly poured into the frame. Although the integral pan allows a concrete floor to be poured directly into the frame, the floor is relatively thin and the only longitudinal support is provided by a pair of narrow exterior framing members. Furthermore, the crossbeams are made of metal and there is no integration of the concrete flooring with the reinforcing beams. This construction suggests a modular unit that, while fairly light weight, is not as durable arid strong as is needed.

Another disadvantage of the module shown in the Davis patent is the presence of an exposed steel frame. Typical present day building codes require air gaps or a crawlspace separation between grade and a frame. Furthermore, the frames must be protected from moisture and the negative effects of corrosion that are imminent. Steel frames must also include an integral vapor barrier to impede moisture intrusion. The Davis patent shows an exposed steel floor frame, which restricts the ability to set module directly on grade.

U.S. Pat. No. 3,918,222 to Bahramin illustrates another approach to a prefabricated modular flooring and roofing system. This patent describes a floor structure having a plurality of concrete beams or slabs that are pre-stressed longitudinally and arranged in parallel to form a waffle-type structure. Each of the beams or slabs is prefabricated with concrete and includes a pair of longitudinally extending sidewalls. The slabs are reinforced by steel,l reinforcing structures that include a series of longitudinally extending reinforcing rods that are passed through holes formed in the concrete.

Although the Bahramin structure enjoys the strength of concrete beams for lateral and longitudinal support, the structure appears to require large amounts of concrete, which is heavy, and requires substantial manual assembly of the external steel reinforcing structure. Furthermore, this structure, although normally precast off-site, requires a great deal of site work specifically associated with the vertical precast members and the foundations required to support them. As such, this system is not relocatable or modular in nature as an entire system or building assembly.

Another approach is shown in U.S. Pat. No. 4,545,169 to Rizk. This patent describes a monolithic reinforced concrete floor with a frame that includes two longitudinal spaced apart open web trusses and a plurality of quadrilateral tubular beams secured between the trusses in spaced apart relation. A reinforcing mesh material is disposed over the trusses and the tubular beams, and a monolithic concrete slab is formed in situ over the frame encapsulating the reinforcing elements and mesh material.

One significant problem with the Rizk system is the number of different components and elements required to assemble a building. The floor unit, while transportable, does not include integral beams and purlins and relies upon a complex external metal supporting structure that must be preassembled in order to construct a building. Furthermore, this system is also restricted in final location because of the use of an exposed steel frame.

Yet another approach to a prefabricated structure for modular building is found in U.S. Pat. No. 3,811,722 to Jones. This patent describes a bow-shaped foundation structure for mobile homes comprising a pre-stressed lightweight concrete base having longitudinally and transversely extending flanges on the underside which give it structural stiffness and rigidity. Pre-stressed steel reinforcing rods or cables are embedded in the flanges and are bent to obtain maximum vertical force vectors at the ends of the concrete structure.

Although the foundation structure shown in the Jones patent provides structural stiffness for portability, the bow-shaped structure appears to utilize a large quantity of concrete which makes it heavy, and the odd bow shape makes it difficult to adapt for use as a base structure or a roof. Furthermore, the structure requires multiple heights of foundation piers to support the structure in its static final location. This complicated foundation design could be very restrictive for high water table sites and large multi-floor complexes requiring many shared footings. In addition, this foundation may tend to direct surface water under the structure and accumulate water at the footings under the center of the building edges.

Still another approach is shown in U.S. Pat. No. 3,944,242 to Eubank. This patent describes a supporting structure for a mobile home comprising pre-stressed concrete. The supporting structure comprises a rectangular floor supported by beams on the lower surface of the floor. A pair of large longitudinal beams are formed on the lower surface of the floor adjacent to longitudinal edge of the floor. A plurality of smaller transverse beams are formed on the lower surface of the floor connecting the longitudinal beams. Both the longitudinal and transverse beams are pre-stressed. The structure is cast in a single piece in a bed provided with channels for the longitudinal and transverse beams. The beams are pre-stressed in a conventional manner either by pre-tensioning or post-tensioning tendons.

While the supporting structure shown in the Eubank patent provides the advantage of being, portable, the lack of vertical reinforcement in the beams and purlins is a potential problem. Furthermore, this system includes corner supported steel leveling legs and end mounted steel beams for transportation, lifting, and setting of the floor system. Any use of these elements in the final static position of the modular unit, such as leveling throughout the life of the structure, would create a code and corrosion problem. There is no mention of vapor barriers or vapor proofing the assembly, which also limits its building code acceptance.

These and other approaches to modular construction components highlight the persisting need for components that are strong and durable, meet current building codes, yet still be easy to transport. Furthermore, there is a clear need for modular building components that, while still modular and readily transportable to a building site, are more attractive and durable than metal/wood trailer-type modular buildings and therefore facilitate construction of structures that are more likely to remain for long term or permanent use.

Accordingly, there is still a need for a prefabricated concrete-based reinforced floor and roof structure for modular buildings. Especially, there is a need for an improved reinforced structure that provides superior compressive strength in the longitudinal and transverse reinforcing elements, provides space for thermal insulation, does not possess an exposed steel frame, is readily transportable, and provides sufficient strength and light weight for transportability and use both as a floor or as a roof structure.

There is also a need for a prefabricated concrete-based reinforced insulated structure for modular buildings that can be used for walls.

SUMMARY OF THE INVENTION

Briefly described, the present invention relates to a supporting structure for modular building units comprising pre-cast reinforced pre-insulated concrete slab, and a method for constructing such a structure. The supporting structure is a rectangular multi-bayed structural unit, suitable for use as a floor system or a roof, supported by composite pre-cast concrete beams integrated from the upper surface to the lower surface of the unit. According to one embodiment, at least a pair of longitudinal beams run parallel to the length of the structure inset from the longitudinal edge, thereby creating a cantilever region. A series of pre-cast reinforced composite crossbeams or purlins run in the transverse direction at regular intervals and cantilever beyond the longitudinal beams. All beams and purlins have integrated deformed reinforcing bar steel and steel channel bottom reinforcement. An upper reinforcement of wire mesh is provided near the top surface, and wired to the reinforcing bars at interval. The steel channel bottom reinforcement includes a plurality of spaced apart upright steel studs welded at regular intervals along the channel. The beams and purlins create a series of structural recessed bays along the underside of the structure.

According to one embodiment, the body of the floor structure has repetitive cast-in-place reinforced concrete ribs of less depth than the beams and purlins, running perpendicular to the longitudinal beams in a transverse direction.

According, to an alternative, more, light weight embodiment, the supporting structure comprises a composite pre-cast concrete slab with an internal foam core having outer layers of welded wire mesh. For additional reinforcement, truss wires piercing the core and welded to the outer mesh layers may be provided. The outer perimeter portions of the structure include integrated deformed reinforcing bar steel reinforcement, thereby internalizing the outer beams. This alternative embodiment is particularly suitable for smaller modular building applications, and does not require the insulation bays as are employed in other embodiments.

For portability, means are provided for attaching a towing hitch and wheeled bogey to the supporting structure.

The various embodiments of the supporting structure are cast in a single piece in an adjustable forming bed that allows for rigid insulating board and studded steel channels to be cast into the supporting structure, where applicable. After the concrete is set, the supporting structure is removed from the forming bed, and the wheels and towing hitch are attached. Threaded anchor bolts, nailing straps, and/or other embedded attachment devices are cast directly into the supporting structure as a means for later attachment for walls and roof assemblies.

More particularly describing a preferred embodiment, the present invention relates to a modular construction unit for use as a floor or ceiling of a modular building. The unit comprises a generally rectangular poured concrete slab with a planar top surface. According to one embodiment, the slab includes a plurality of longitudinal beams extending downwardly from the bottom of the slab, poured integral with the slab, the longitudinal beams disposed spaced inwardly a predetermined distance from an outer peripheral edge of the slab thereby defining a cantilever region. The length of the cantilever can be varied to provide an option of a perimeter beam capability, if desired. The slab further includes plurality of transverse purlins extending downwardly from the bottom of the slab, poured integral with the slab, with a pair of said transverse purlins disposed coterminous with opposite outer peripheral edges of the slab.

The beams and purlins define a plurality of rectangular voids on the underside of the slab. Rigid polystyrene foam insulating material fills the rectangular voids for thermal and sound insulation as well as providing a vapor barrier.

A plurality of ribs is also provided extending downwardly from the bottom of the slab. The downward extent of the ribs is preferably less than the downward extent of the beams and purlins. The ribs extend transversely and parallel to the purlins out to a peripheral edge of the slab.

The construction unit further comprises an internal metal reinforcement matrix within the slab. This reinforcing matrix comprises a plurality of deformed bar reinforcing metal rods extending horizontally within the beams, purlins, and ribs. A plurality of continuous steel channels extends along the bottom edges of the beams and purlins. A plurality of metal studs spaced at intervals is affixed to and extends upwardly from the channels into the beams and purlins. The metal studs include hooks at the upward ends thereof extending into the concrete of the slab. A metal wire grid is embedded within an upper region of the slab.

In an alternative arrangement, a plurality of support tubes is embedded into corners of the slab, affixed to the steel channels. The support tubes open into the top surface of the slab for receiving vertical support members utilized in a modular building. Preferably, the support tubes are affixed to the deformed bar reinforcing metal rods within the purlins that extend to the corners of the slab.

The modular construction unit preferably further comprising wall support elements embedded into the top surface of the slab for providing means for attaching and securing side walls of a building to form a completed structure.

Accordingly, it is an object of the invention to provide an improved prefabricated concrete-based reinforced floor and roof structure for modular buildings.

It is another object of the invention to provide an improved concrete-based modular building structural unit that provides superior compressive strength in the longitudinal and transverse reinforcing elements of a prefabricated concrete structure, provides space for thermal insulation, is readily transportable, and provides sufficient strength and light weight for transportability and use both as a floor or as a roof structure.

It is another object of the present invention to provide an improved concrete-based modular building structural unit that includes an insulating material filling the structural voids for thermal and sound insulation as well as providing a vapor barrier.

It is another object of the present invention to provide an improved concrete-based modular building structural unit that can be set directly on grade and does not have an exposed frame.

These and other objects, features, and advantages of the present invention may be more clearly understood and appreciated from a review of the following detailed description and by reference to the appended drawings and claims.

DETAILED DESCRIPTION OF THE PREFERRED EMBODIMENTS

Figure 1:
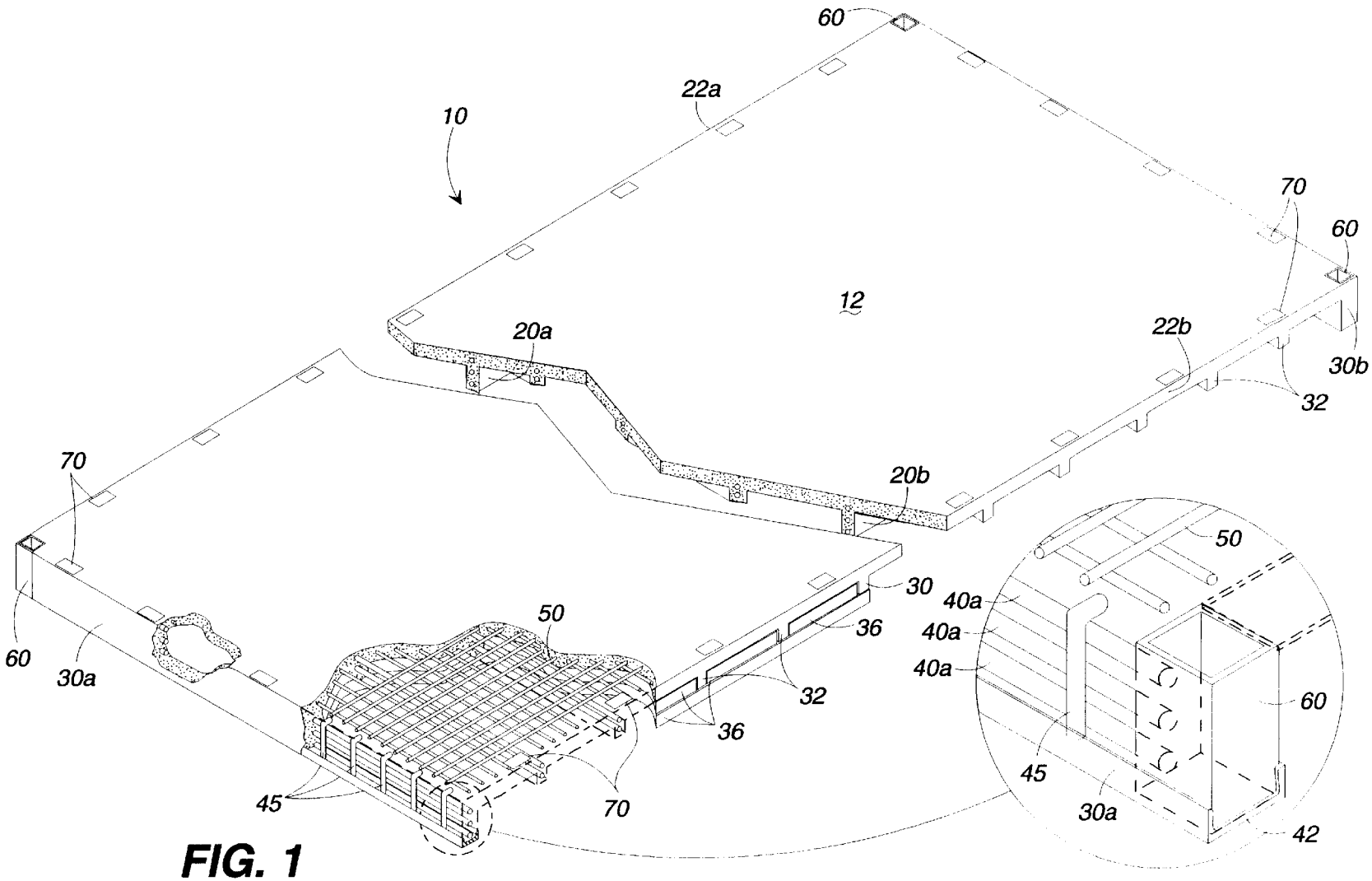
FIG. 1 is a perspective top view of a modular building construction unit constructed in accordance with the preferred embodiments of the present invention, partially broken away to reveal interior features.

Referring now to the drawings, in which like numerals indicate like elements throughout the several views, FIG. 1 illustrates a prefabricated construction unit 10 for a modular building constructed in accordance with the preferred embodiment of the present invention. The construction unit 10 is a generally rectangular poured concrete slab with a 2 inch thick planar top surface 12 that forms an upper surface suitable for use as flooring in a modular building. The preferred unit is of a size suitable for conventional road tractor-pulled transportation on a road or highway, of preferably no more than 16 feet wide by 72 feet long, but still more preferably 12 feet wide by 36 feet long.

Figure 2:
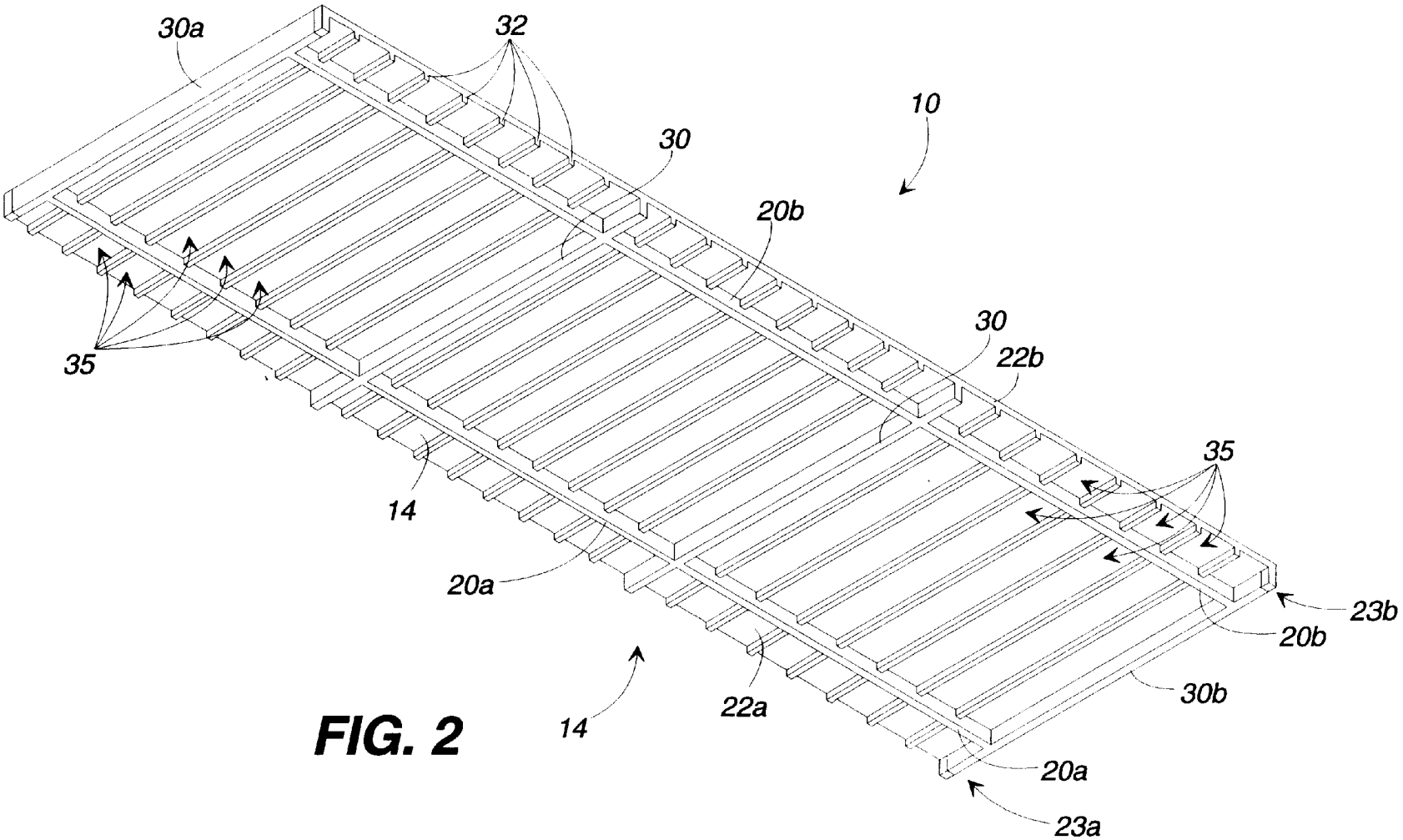
FIG. 2 is a perspective bottom view of the modular construction unit of FIG. 1.
Figure 3:
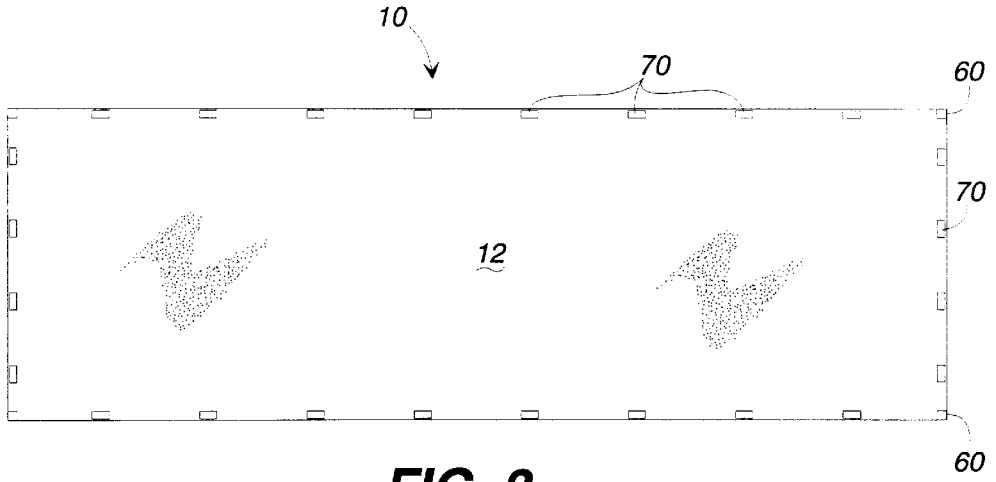
FIG. 3 is a top plan view of the preferred modular construction unit of FIG. 1.
Figure 4:
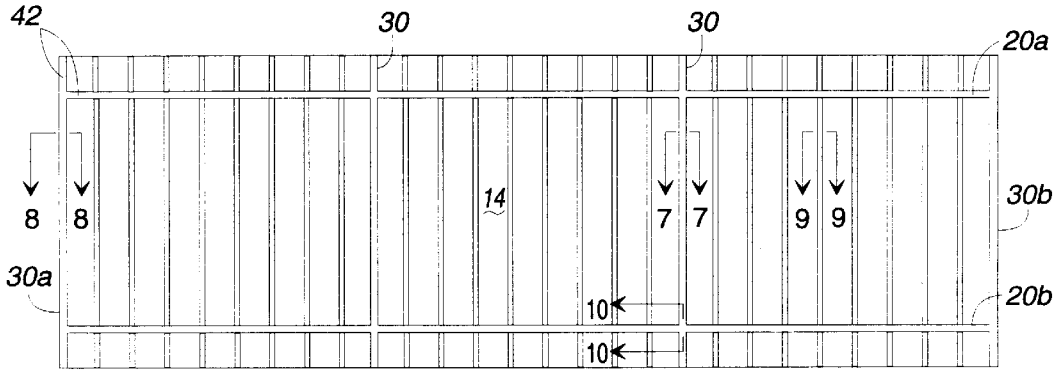
FIG. 4 is a bottom plan view of the preferred modular construction unit of FIG. 1.
Figure 5:
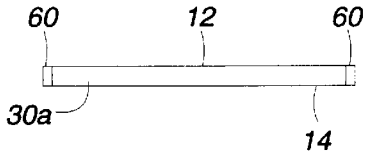
FIG. 5 is a end elevational view of the preferred modular construction unit of FIG. 1.
Figure 6:
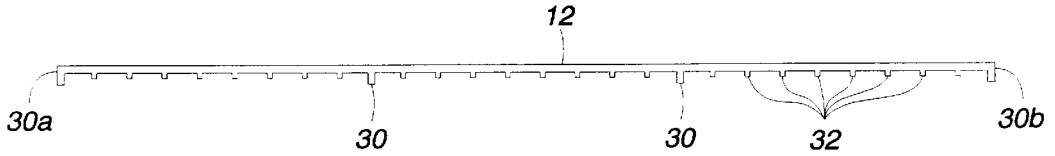
FIG. 6 is a side elevational view of the preferred modular construction unit of FIG. 1.

Referring to FIG. 2, the construction unit 10 has a corrugated bottom surface 14 comprising at plurality of beams 20, purlins 30, and ribs 32. Preferably, there is a pair of longitudinal beams 20*a*, 20*b* that extend downwardly from the bottom surface of the slab, poured integral with the slab, that provide a lower support surface for the unit. These longitudinal beams 20 are displaced inwardly from the longitudinal edges 22*a*, 22*b*, respectively, so as to provide a cantilever region 23*a*, 23*b* extending along the length of the construction unit. The beams are preferably 12 inches thick measured from the bottom of the beam to the top surface 12 and 5 inches wide.

Still referring to FIG. 2, the construction unit 10 includes a plurality of transverse purlins 30 extending downwardly from the bottom of the slab, poured integral with the slab. The purlins have the same downward extent as the longitudinal beams 20 and provide a lower support surface for the construction unit. In the preferred embodiment, a pair of the transverse end purlins 30*a*, 30*b* are disposed coterminous with and forming opposite outer transverse peripheral edges of the slab. Each purlin is preferably 12 inches thick measured from the bottom of the purlin to the top surface 12, and 5 inches wide.

The preferred construction unit 10 further includes a plurality of transversely extending ribs 32 extending downwardly from the bottom of the slab. The downward extent of the ribs 32 is less than the downward extent of the beams and purlins, and are spaced apart a predetermined distance between a pair of purlins. Preferably, the ribs 32 extend transversely and parallel to the purlins out to the peripheral longitudinal edges 22 of the slab. Each rib is preferably 6 inches thick measured from the bottom of the rib to the top surface 12 and 2 inches wide. In the preferred embodiment the ribs are parallel to the purlins, but in an alternative arrangement the ribs may be constructed to extend longitudinally and parallel to the beams.

The ribs are preferably spaced apart at 18 inches, with a purlin occurring every eight rib bays. The two end purlins align with the ends of the slab, making the first and last rib bay 18 inches from the purlin face to the rib center. Thus, a 36 foot long construction unit will have four purlins creating three purlin bays of 12 feet 0 inches, having three sections of 8 ribs yielding 22 bays of 18 inches and 2 bays of 16 inches, with a total of 28 transverse elements.

As best seen in FIG. 2, together the beams, purlins, and ribs define a plurality of rectangular voids 35 on the underside of the slab. As will be discussed below, these rectangular voids are filled with rigid polystyrene foam insulating material 36 up to the downward extent of the beams and purlins, thereby defining a lower surface.

Referring back to FIG. 1, the preferred construction unit 10 further includes an internal metal reinforcement matrix embedded with the slab. The internal reinforcement matrix comprises several reinforcing elements preferably fabricated from deformed bar metal rods. Each of the beams, purlins and ribs include at least once deformed bar reinforcing metal rod extending horizontally across the length of the beam, purlin or rib. Referring in particular to the end purlin 30*a* in FIG. 1, there are preferably three deformed bar reinforcing metal rods 40*a*, 40*b*, 40*c* positioned generally centrally of the purlin 30, spaced apart, stacked vertically relative to one another, extending parallel across the length of the purlin. The metal rods are preferably ⅝ inch (#5) rebar. The topmost rod 40*a* is preferably embedded ⅝ inch deep relative to the top surface 12 of the unit, ⅝ inch from the outer edge.

The same basic preferred structure of three parallel spaced apart vertically stacked reinforcing rods is provided in each of the longitudinal beams 20, except of course that the bars extend longitudinally within the beams.

The metal reinforcement matrix further includes continuous steel channels 42 extending along the, bottom edges of the beams 20 and purlins 30. The preferred steel channels 42 are generally U-shaped, of the same width as the beam or purlin, and filled with concrete during the casting process. The preferred channels are thus 5 inches wide, made of ¼ inch thick steel.

It will thus be appreciated that the bottom-most extent of all beams and purlins preferably is exposed steel, but (as will be discussed) the remainder of the slab is covered by the insulating foam material to provide a vapor barrier. The exposed steel provides substantial lateral and longitudinal rigidity and strength to the construction unit as a whole and forms a contact surface for the construction unit to rest atop support pads in the field. Furthermore, the steel provides weld receptor surfaces for hold-down (anti-lift) capability.

The metal reinforcement matrix further includes a plurality of ½ inch diameter metal studs (#4 rebar) 45 that are affixed to and extend upwardly from the channels 42 and into the concrete material of the beams and purlins. The metal studs are spaced apart at intervals preferably about 12 inches and are positioned alongside but spaced slightly apart from the horizontally extending metal rods 40. The metal studs 45 are preferably stud-welded around the base of the stud onto the inner bottom-most surface of the steel channels 42. Fillet welds of ¼ inch are employed in the preferred embodiment.

The studs 45 preferably include a right angled bend or "hook" 46 that is turned inwardly towards the center of the construction unit, extending over the topmost horizontally extending metal rod 40*a*. If desired, the hooks of the studs or the studs themselves could be welded to the horizontally extending metal rods 40, but this adds additional welding step and is not believed necessary.

Finally, the metal reinforcement maltrix within the slab comprises a metal wire mesh or grid 50 embedded within the top 2 inches of concrete above the beams, purlins, and ribs. The metal wire grid 50 comprises a plurality of spaced apart W1.4×W1.4 parallel steel wires, 6 inch by 6 inch spacing, welded at the intersections, extending horizontally in both the longitudinal and transverse directions. The wire mesh is preferably embedded at about 1½ inches below the topmost surface 12, with ⅝ inch of concrete above the topmost metal rod. Preferably, the metal wire grid is wired to the topmost of the deformed bar metal rods 40, such as 40*a*, so as to retain the metal wire grid within the mass of the concrete when the concrete is poured.

The preferred construction unit 10 further comprises a plurality of support tubes 60 embedded into corners of the slab. Each support tube 60 is preferably 3/16 inch thick structural steel tube, square in cross section and hollow, 3½ inches by 3½ inches by 12 inches. As shown in FIG. 1, the support tubes are affixed to the steel channels 42 by welding at the bottom end. The steel tubes open into the top surface 12 of the slab and are operative for receiving vertical support members utilized in construction of a modular building.

The support tubes 60 are also preferably welded to and support the deformed bar metal rods such as 40*a*, 40*b*, 40*c* that extend transversely across the end most purlins 30*a*, 30*b*. The metal rods are butt-welded to a side of the support tube, or alternatively may be stud-welded and wire-tied.

Figure 8:
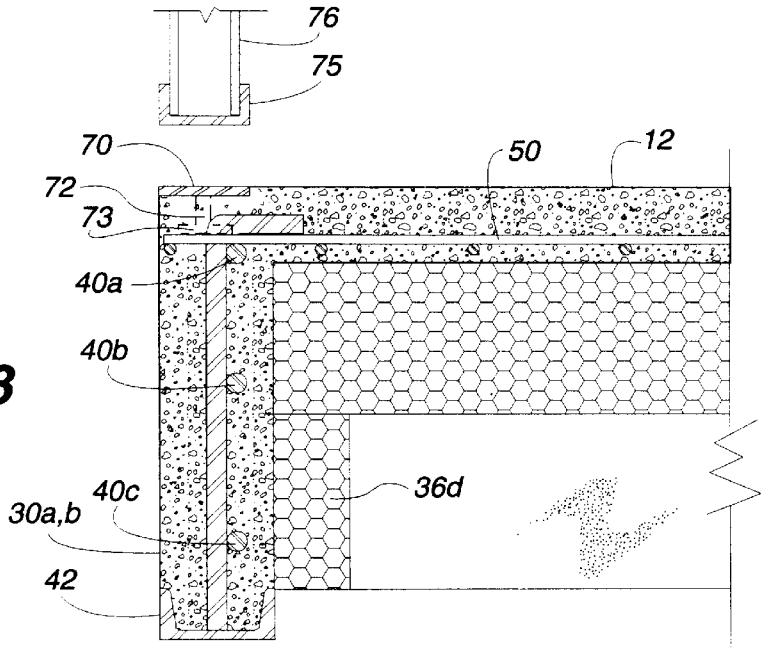
FIG. 8 is a partial cross sectional view of an end purlin of the preferred modular construction unit taken along the line 8—8 of FIG. 4.

As best seen in FIG. 1 and FIG. 8, the preferred construction unit 10 preferably also includes a plurality of longitudinally and laterally extending metal stud support plates 70 embedded into the top surface 12 of the slab, of a standard width of 3⅝ inches and a length of 6 inches. The stud support plates 70 include a downwardly-extending retainer stud 72 welded to the bottom surface, with a disk-shaped flange 73 of a larger diameter than that of the stud to assist in retainage of the stud support plate within the concrete of the slab. In constructing a modular building, a conventional C-shaped metal stud track 75 is fastened to the stud support plate 70 by concrete nailing, concrete screws, or welding, as desired. The metal stud track 75 houses and supports conventional 3⅝ inch vertical construction studs 76 for wall construction in the conventional manner.

Figure 7:
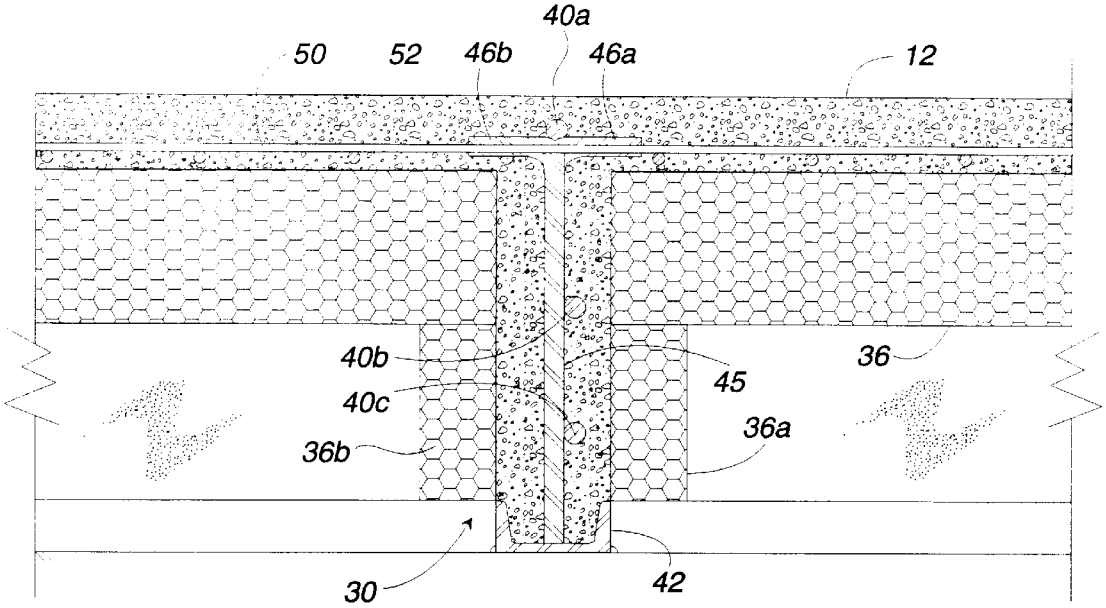
FIG. 7 is a partial cross sectional view of a center purlin of the preferred modular construction unit taken along the line 7—7 of FIG. 4.

FIG. 7 illustrates the cross section of a center purlin 30. The upright metal studs 45 employed within a center purlin 30 (as contrasted to the outer purlins 30*a*, 30*b*) are affixed to the channel 42 such that the horizontally extending hooks 46 alternate in direction. In other words, a first upright stud 45 will have a hook 46*a* extending in one direction, while the adjacent stud 45 will have, a hook 46*b* extending in the diametrically opposite direction.

Furthermore, it can be seen in FIG. 7 that the uppermost metal bar rod 40*a* is embedded ⅝ inch deep within the slab adjacent to the metal wire grid 50 and welded thereto or alternatively tied with a metal wire 52.

FIG. 7 also illustrates the preferred placement of the rigid foam insulating material 36. Preferably, the foam is preformed into solid blocks 4 inches thick, cut to size at the forming site and filling the voids 35, prior tic the concrete pour. For a center purlin 30 such as shown in FIG. 7, 3 inch thick section of insulating material 36*a*, 36*b* are placed on each side of the purlin to provide for complete insulation extending along the entire purlin. The insulation further provides a vapor barrier for the unit.

FIG. 8 illustrates the construction of one of the end purlins 30*a*, 30*b*. As in the case of a center purlin, the insulating material 36 is applied to fill the void, and includes a 3 inch thick block 36*d* affixed on the inside of the purlin, but leaving the outside of the purlin on the outer edge blank uncovered. The topmost transverse metal rod 40*a* is positioned ⅝ inch from the top surface 12 of the unit, ⅝ inch from the outer edge of the purlin.

Figure 9:
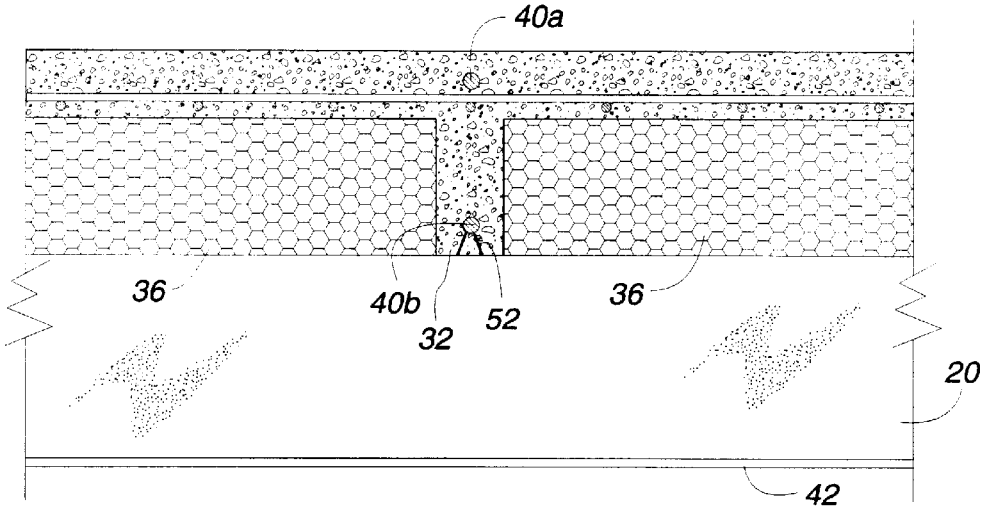
FIG. 9 is a partial cross sectional view of a transverse rib of the preferred modular construction unit taken along the line 9—9 of FIG. 4.

FIG. 9 illustrates a cross-sectional view of a rib 32. Each of the transversely extending ribs includes a pair of horizontally extending #4 deformed bar metal rods 40*a*, 40*b*, with the topmost rod 40*a* displaced ⅝ inches deep from the top surface. The lowermost rod 40*b* is supported on ¾ inch wire "chairs" 55 at the bottom of the rib, for support of the metal during pouring of the slab.

FIG. 9 also illustrates that the preferred fill depth of the insulation 36 at four inches is sufficient to create a continuous surface comprising the insulating material 36 and the bottom of the rib 32.

Figure 10:
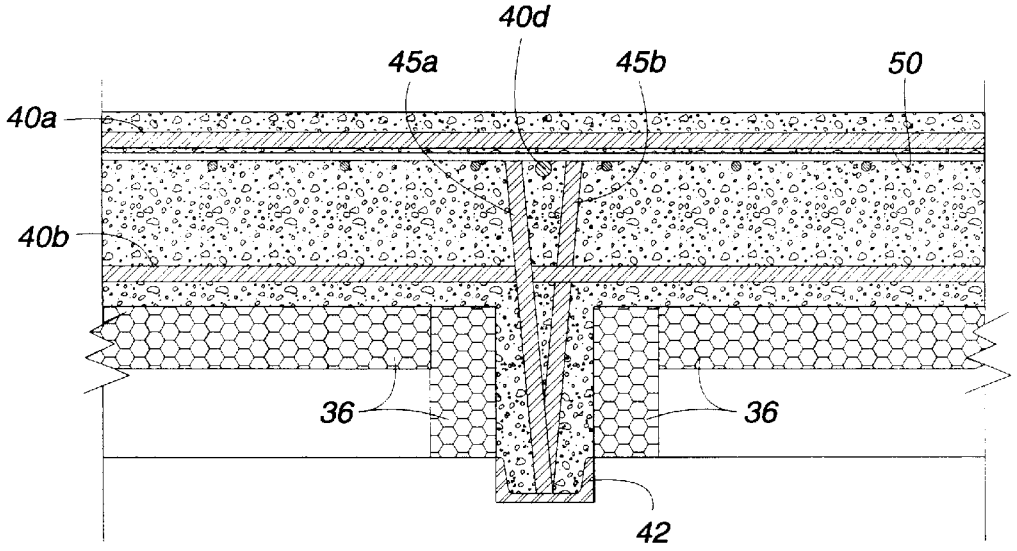
FIG. 10 is a partial cross sectional view of a longitudinal beam of the preferred modular construction unit taken along the line 10—10 of FIG. 4.

FIG. 10 illustrates the cross section of one of the longitudinal extending beams 20. Each beam preferably includes at least one longitudinally extending metal rod 40*d*, preferably #10 rebar, positioned below the wire matrix 50 and welded thereto. A pair of transversely extending metal rods 40*a*, 40*b* of a rib are shown, to illustrate how the rods pass through the beam.

It is preferred that the upright metal studs 45 of a beam are alternately angularly offset, such as shown at 45*a*, 45*b*, to provide proper concrete coverage of the bars.

FIG. 10 also illustrates that the insulation 36 only extends as far down along the sides of the beam 20 to the point of beginning of the metal of the u-shaped channel 42.

Figure 11:
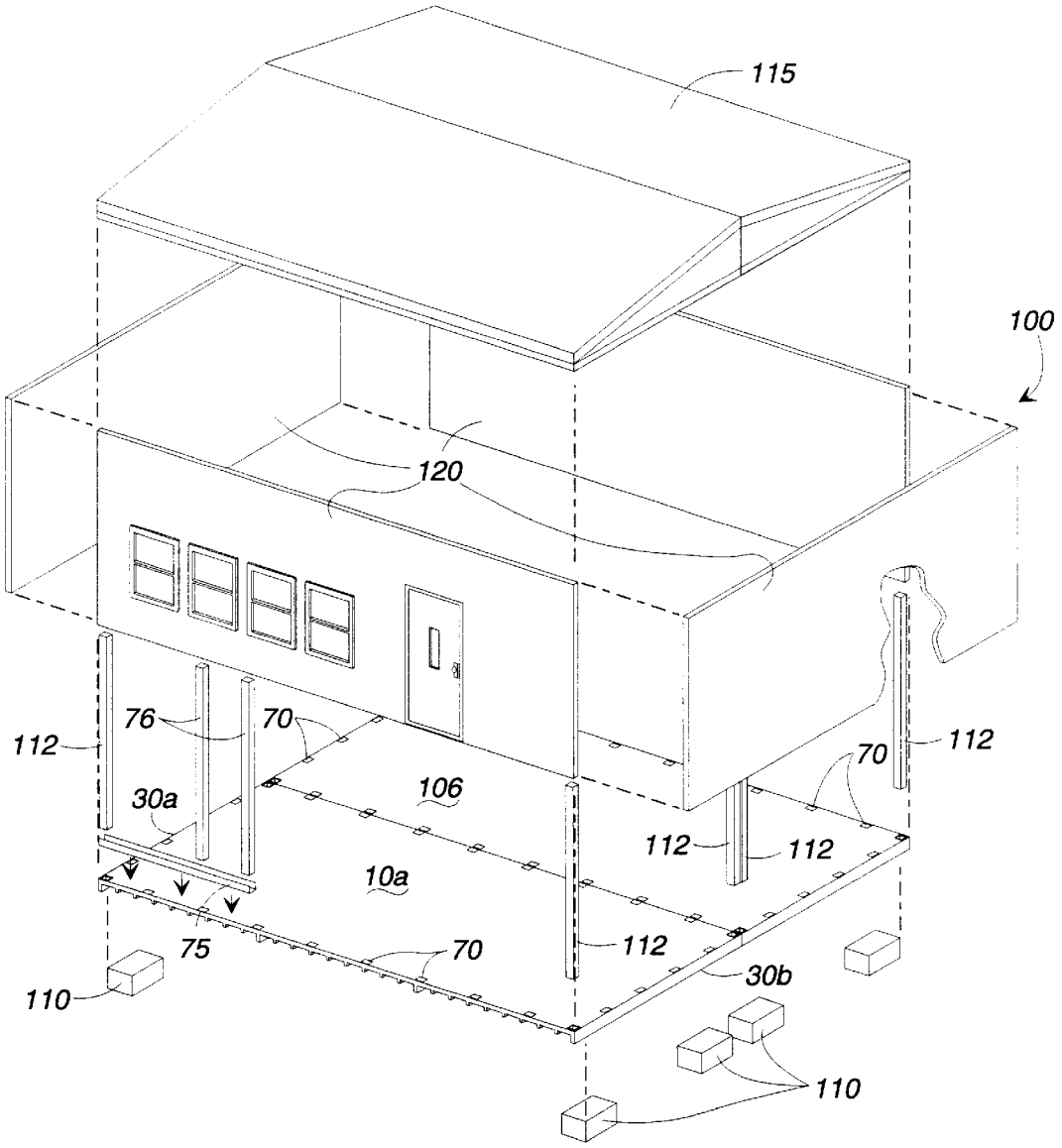
FIG. 11 is an explore view of a single-story modular building constructed with the preferred modular construction unit, showing how walls, roof, etc. attach to form a complete building.

FIG. 11 illustrates how to construct a modular building utilizing a construction unit 10 made in accordance with the preferred embodiment of the present invention. For a typical building 100 of a "double-wide" size, a pair of construction units 10*a*, 10*b* form the floor of the building. The building is supported on a plurality of support or leveling pads 110 which are generally rectangular box-like concrete pads either preconstructed and buried flush with the ground surface or alternatively poured in place flush faith the ground surface.

Figure 12:
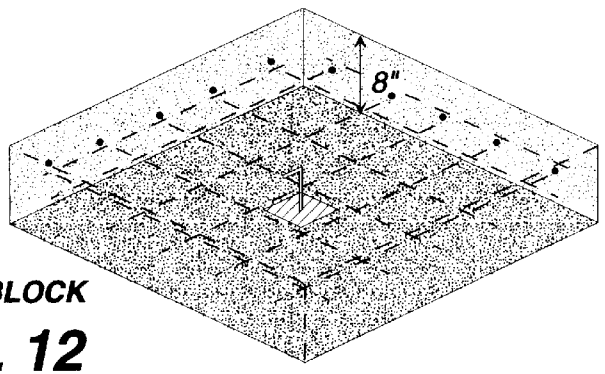
FIG. 12 illustrates the preferred pad blocks for supporting a modular construction unit.

As shown in FIG. 12, the pads 110 are preferably of two sizes, a 24 inch pad or a 36 inch pad. Each pad is square and 8 inches thick. The pad contains an inner reinforcement matrix of horizontal #4 rebar rods, spaced apart 8 inches, with a top layer of parallel rods ¾ inches from the top and a bottom layer orthogonal to the top layer ¾ inches from the bottom surface. A ¼ inch steel plate, 5 inches by 5 inches is embedded into the center of the pad. The steel plate has a ½ inch diameter metal rod 6 inches long welded thereto extending into the concrete, with a 3 inch right angle leg.

Preferably, the 36 inch pads are employed at each corner of a modular building, and the 24 inch pads are employed at 12 foot spacings along the length of the construction unit, and 9 foot spacings along the width.

The preferred modular construction units 10*a*, 10*b* rest atop the upper surfaces of the pads 110. In particular, the bottom surfaces of the metal channels 42 of the outermost purlins 30*a*, 30*b* rest directly atop the pads. If desired, the metal of the channels 42 may be welded to the metal plates embedded within the pads 110.

Referring again to FIG. 11, upright corner posts 112 are fitted within the support tubes 60, and may be welded thereto if desired for additional permanence. The C-shaped continuous metal stud tracks 75 are then fastened to the intermittently spaced apart metal stud support plates 70, along the outer peripheral edges of the two units 10*a*, 10*b* where exterior walls with studs are to be mounted. If desired, an entire prefabricated wall unit such as shown at 120 may be then fastened to the upright corner posts 112 to complete the walls. Alternatively, other types of outer wall surfaces can be employed by fastening to the upright studs 76.

It will be appreciated that the prefabricated wall unit 120 may be made in the same manner as the construction unit 10, with preplacement of frames for doors and windows, insulation, reinforcement, etc. Accordingly, the present invention has utility for use as a floor, wall, or roof of a modular building.

Finally, a roof 115 may be mounted by affixing appropriate trusses, joists, and the like, or by lowering a preconstructed roof unit. Roof slope varies in direction and height to respond to site considerations.

Figure 13:
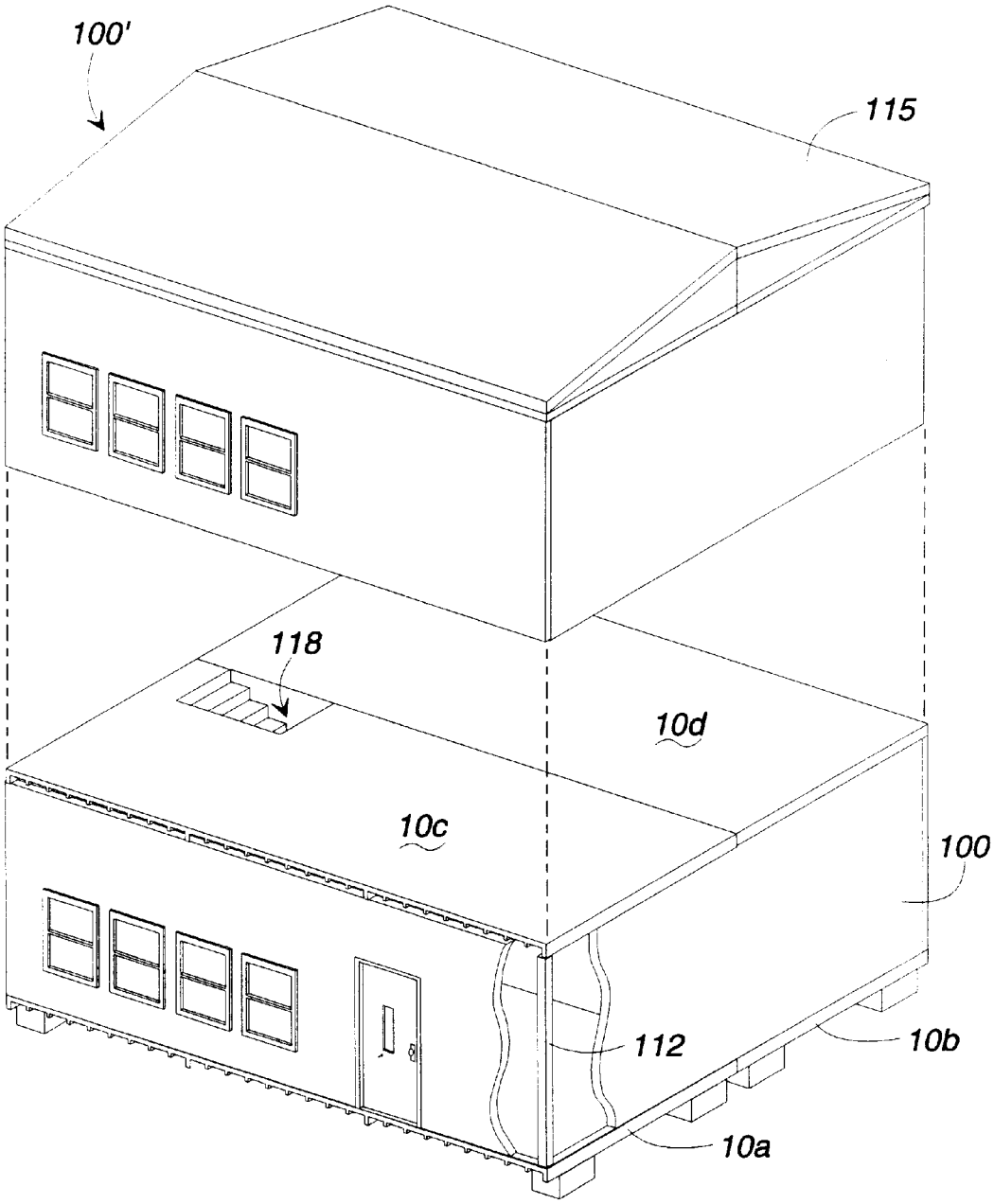
FIG. 13 is an exploded view of a two-story modular building constructed with the preferred modular construction unit.

FIG. 13 illustrates the manner in which the preferred construction unit 10 can be employed to construct a multi-story modular building 100'. A multi-story construction involves utilization of an additional upper layer pair of construction units 10*c*, 10*d* that rest atop the corner posts 112. Because of the structural strength of the preferred construction unit 10 and the extensive use of insulating material around the beams, purlins, and ribs, the present invention is suitable for applications such as prisons, schools, and other institutional facilities where it is desirable to maintain thermal and/or sound insulation between floors.

If desired, a unit constructed as described can be provided with a rectangular opening or cut-out 118 for a stairwell in applications involving multi-story construction. Those skilled in the art will understand that the preferred approach to forming a stairwell is to form the opening in advance by terminating the metal matrix of the ribs, purlins, etc., and by providing a welded metal box (not shown) defining the opening 118 of the stairwell. The interior reinforcing matrix should preferably be welded or otherwise affixed to the metal box for strength and durability.

Figure 14:
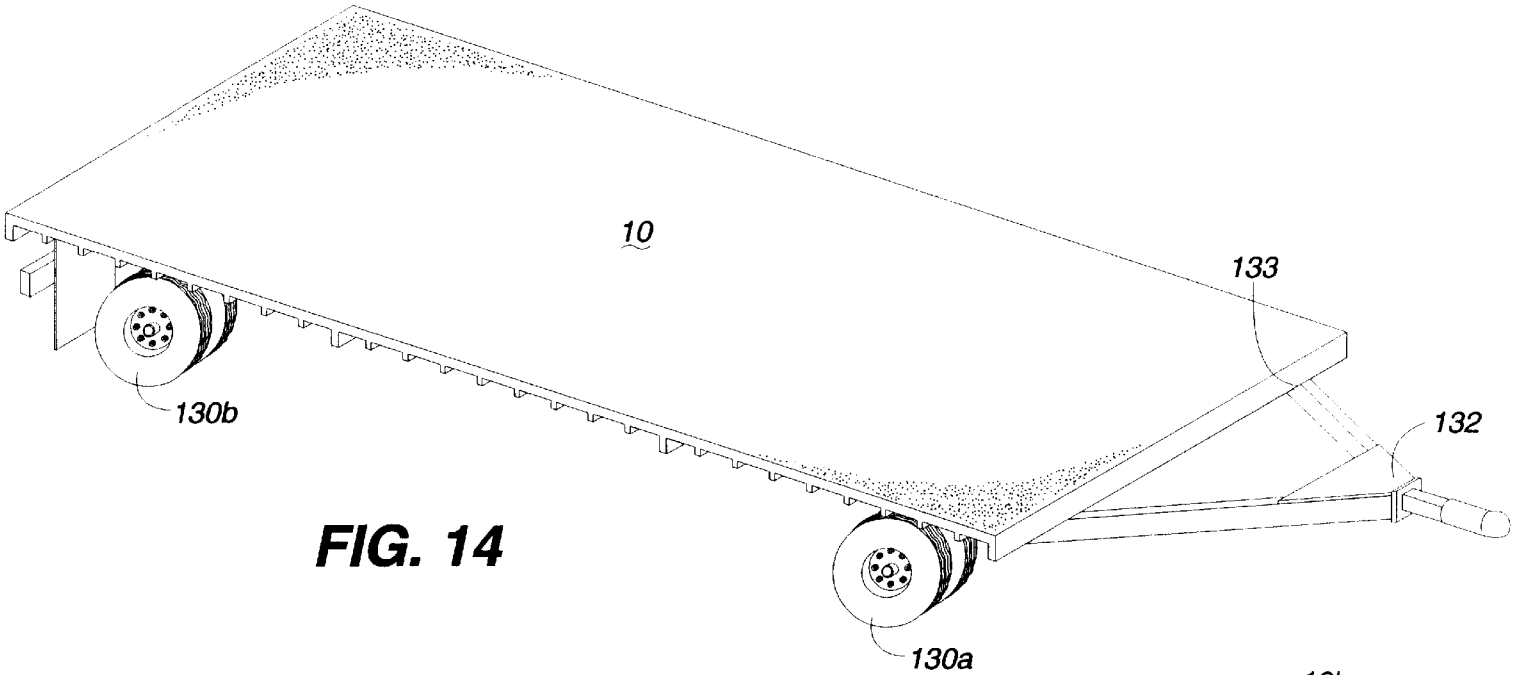
FIG. 14 illustrates how the preferred modular construction unit is configured for transportation with a towing hitch and wheeled bogey.

FIG. 14 illustrates the manner in which a construction unit 10 can be readily transported to a construction site after fabrication. The preferred construction unit of the standard width and length of 12 feet by 36 feet is acceptable for transportation codes and regulations for similarly sized mobile homes and prefabricated modular buildings. In order to transport a unit or an entire modular preconstructed building, the unit may be provided with wheeled dollies or bogies 130 fitted with support members (not shown) to retain and support the unit. The forwardmost of the wheeled dollies may be provided with a trailer hitch 132 that is provided with notches 133 to receive and retain the lowermost extending surfaces of the edge purlin 30*a* during transportation.

Advantageously, a construction unit made as described herein can be lifted from the bottoms, sides or top, as the unit possesses sufficient lateral and longitudinal rigidity to be handled as a unit without undue risk; of breakage or deformation.

It will also be appreciated that the end-most transverse purlins 30*a*, 30*b* may be offset from the outer edges to provide a similar cantilever region as that of the beams 20, if desired. Similarly, the longitudinal beams may be moved to the outer longitudinal edges instead of being offset, as an alternative embodiment.

In order to make a construction unit 10 in accordance with the described preferred embodiment of the invention, the following steps are taken. First, the maker installs adjustable form edges for the slab length and width. The form edges are placed on a level surface or structurally stable material, preferably a properly supported, concrete slab.

Next, a 4 mil plastic sheet vapor barrier is installed within the form to stop moisture loss or transmission between the form and the casting. Next, insulation 36 in the form of slabs or boards of predetermined thickness (e.g. 4 inches thick) are precut and laid within the form to form concrete-receiving pockets for defining the beams, purlins, and ribs.

The next step is to install the steel channel 42 with prewelded studs 45 by placing the channel assembly within the beam and purlin pockets defined by the insulation foam. Preferably, the prewelded assemblies are employed are lifted and placed into the forms as an element thereby reducing the risk of sparking and fire. Wire chairs 55 are then located in the rib pockets for supporting the lowermost rods e.g. 40*b*.

Deformed bar rods are then wired to the wire chairs 55 and to the deformed bar studs 45. The wire mesh or grid 50 is then placed at the selected predetermined depth relative to the top surface and wired to the deformed bars and studs. Additional bars are wired to the mesh as required.

Concrete mix is then poured into the form directly from a mixing operation or pumped in place. Voids are preferably vibrated to fill all areas properly. All concrete is mixed, placed, and finished in accordance with American Concrete Institute requirements. The top surface 12 is leveled and preferably trowel finished.

Figure 15:
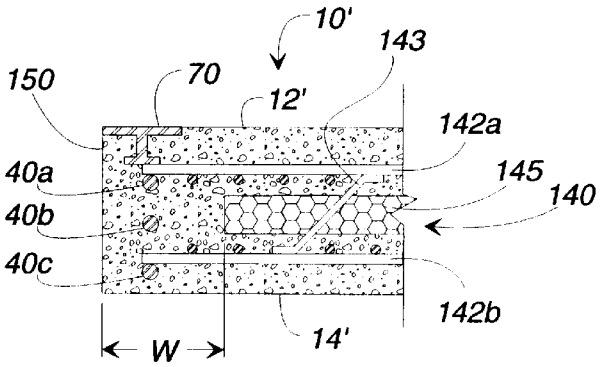
FIG. 15 is a partial cross sectional view of an alternative embodiment of the present invention.

FIG. 15 illustrates an alternative, more light weight embodiment of the present invention, particularly suitable for smaller modular building applications. The alternative form of the invention comprises a supporting structure 10' taking the form of a concrete slab with a flat top 12' and bottom 14'. This slab is formed in a mold similar to process described above, but does not gap the insulation to create beams, purlins, ribs, and bays.

Inside the structure 10' is an internal composite insulating and reinforcing structure 140. The, structure 140 comprises a foam core 145 inside a "sandwich" of outer layers of wire mesh 142*a*, 142*b*. The structure 140 can be assembled from discrete components, or can be a preconstructed commercially available product such as the Insteel 3-D® panel system, available from Insteel Construction Systems, Inc., Brunswick, Ga. The Instel 3-D® panel system comprises a core of modified expanded polystyrene, flanked by 2"×2" welded wire mesh, connected with galvanized truss wires 143 that pierce the core and are welded to the outer mesh layers.

As shown in FIG. 15, the foam core 145 is generally rectangular and flat, of a thickness less than that of the overall structure. For example, a four inch thick rigid board insulation for the foam core allows for two inches of concrete on either side to form an 8 inch thick unit.

The welded wire mesh 142*a*, 142*b* is provided on either side of the foam core. If assembled from discrete components instead of a preconstructed product such as the Insteel 3-D® panel system, the wire mesh is preferably 6" by 6", #10×#10 wire, supported approximately ½ inch from the top surface 12' and bottom surface 14'. Optionally, the wire mesh may be supported by truss wires 143 that pierce the core and are welded to the wire mesh.

The thickness of the entire unit 10' is preferably 8 inches, and the wire mesh 142*a*, 142*b* is spaced apart from the foam core a slight distance to allow concrete to flow completely around and encapsulate the wire mesh and surround the foam core to make an integral unit.

Preferably, the foam core is cut to a predetermined distance W from the outer edge 150 of the unit, to provide room for reinforcing metal bars or rods 40*a*, 40*b*, 40*c* and define perimeter beams and purlins, where W defines the width of an internalized beam or purlin. The reinforcing metal rods 40*a*, 40*b*, 40*c* are positioned generally centrally of region W, spaced apart, stacked vertically relative to one another, extending parallel across the length and width of the unit at the edges. If desired, support tubes 60 (not shown) and stud support plates 70 may be provided as in the other embodiments. Preferably, the wire mesh 142*a*, 142*b* extends into the region W and is welded to the top metal rod 40*a* and bottom metal rod 40*c*.

The region W is preferably formed around the entire perimeter of a generally rectangular supporting structure 10', thereby defining internalized beams and purlins. In such an embodiment, there are no separate bays for insulation, as the entire unit includes the internalized foam core to provide insulation and effect weight reduction.

It will be appreciated that as a building reduces in size, a structure 10' as described with an internalized foam core and perimeter beams and ribs/purlins provides for weight reduction and simplified construction, without compromising strength and versatility. The various sizes available for transport, building use, and soil conditions define the depth, thickness, reinforcing, and weight of the slabs. The depth of the beams and ribs and integration of the flat slab option are directly affected by these elements.

It will be understood that the foregoing relates only to the preferred embodiments of the present invention, and that numerous changes may be made therein without departing from the spirit and scope of the invention as defined by the appended claims.

What is claimed is:

1. A modular construction unit for use as a floor or ceiling of a modular building, comprising:

a generally rectangular poured concrete slab with a planar top surface comprising:

a plurality of longitudinal beams extending downwardly from the bottom of the slab and integral with the slab;

a plurality of transverse purlins extending downwardly from the bottom of the slab and integral with the slab;

the beams and purlins defining a plurality of rectangular voids on the underside of the slab filled substantially with insulating material to form an integral unit with said slab;

a plurality of ribs extending downwardly from the bottom of the slabs, positioned between the purlins, the downward extent of the ribs less than the downward extent of the beams and purlins;

an internal metal reinforcement matrix within the slab, comprising:

deformed bar reinforcing metal extending horizontally within the beams and purlins;

a plurality of continuous steel channels extending along the bottom edges of the beams and purlins;

a plurality of metal studs spaced at intervals and affixed to and extending upwardly from the channels into the beams and purlins, and a metal wire grid embedded within an upper region of the slab.

2. The modular construction unit of claim 1, wherein the ribs extend transversely, and parallel to the purlins.

3. The modular construction unit of claim 1, wherein the ratio of the number of ribs to the number of purlins is greater than 6:1.

4. The modular construction unit of claim 3, wherein there are at least seven ribs disposed between a pair of purlins.

5. The modular construction unit of claim 1, wherein the ribs extend to an outer peripheral edge of the slab.

6. The modular construction unit of claim 1, further comprising deformed bar reinforcing metal extending horizontally within the ribs.

7. The modular construction unit of claim 1, wherein the insulating material comprises rigid polystyrene foam.

8. The modular construction unit of claim 1, wherein the longitudinal beams are disposed spaced inwardly a predetermined distance from an outer peripheral edge of the slab thereby defining a cantilever region.

9. The modular construction unit of claim 1, wherein a transverse purlin is disposed coterminous with an outer peripheral edge of the slab.

10. The modular construction unit of claim 1, further comprising a plurality of support tubes embedded into corners of the slab and opening into the top surface of the slab for receiving vertical support members utilized in a modular building.

11. The modular construction unit of claim 10, wherein the support tubes are affixed to the steel channels.

12. The modular construction unit of claim 10, wherein the support tubes are affixed to the deformed bar reinforcing metal within a beam or purlin that extends to a corner of the slab.

13. The modular construction unit of claim 1, wherein the deformed bar reinforcing metal comprises at least one metal rod extending along the length of the beams and purlins.

14. The modular construction unit of claim 13, wherein the deformed bar reinforcing metal includes up to three metal rods.

15. The modular construction unit of claim 1, wherein the metal studs include hooks at the upward ends thereof and extending into the concrete of the slab.

16. The modular construction unit of claim 15, wherein the hooks of the metal studs within a beam or purlin extend over the topmost deformed bar reinforcing metal of a plurality of vertically stacked deformed bars within the respective beam or purlin.

17. The modular construction unit of claim 1, wherein the metal wire grid is affixed to said deformed bar reinforcing metal.

18. The modular construction unit of claim 1, further comprising wall support elements embedded into the top surface of the stab for providing means for attaching and securing side walls of a building to form a completed structure.

19. A modular construction unit for use as a floor or ceiling of a modular building, comprising:

a generally rectangular poured concrete slab with a smooth planar top surface comprising:

a plurality of longitudinal beams extending downwardly from the bottom of the slab and integral with the slab;

a plurality of transverse purlins extending downwardly from the bottom of the slab and integral with the slab;

the beams and purlins defining a plurality of rectangular voids on the underside of the slab;

insulating material substantially filling the rectangular voids to form an integral unit with said slab;

a plurality of ribs extending downwardly from the bottom of the slabs, the downward extent of the ribs less than the downward extent of the beams and purlins, the ribs extending to the outer peripheral edge of the slab; and an internal metal reinforcement matrix within the slab, comprising:

a plurality of parallel deformed bar reinforcing metal rods extending horizontally within and along the length of at least some of the beams and purlins;

a plurality of continuous steel channels extending along the bottom edges of the beams and purlins;

a plurality of metal studs spaced at intervals and affixed to and extending upwardly from the channels into the concrete of the beams and purlins, with hooks at the ends extending over the topmost reinforcing metal rod into the concrete; and a metal wire grid embedded within an upper region of the slab and affixed to one of said deformed bar reinforcing metal rods.

20. The modular construction unit of claim 19, wherein the ribs extend transversely and parallel to the purlins.

21. The modular construction unit of claim 19, wherein the ratio of the number of ribs to the number of purlins is greater than 7:1.

22. The modular construction unit of claim 19, wherein the ribs extend transversely and parallel to the purlins.

23. The modular construction unit of claim 19, wherein the ribs extend to an outer peripheral edge of the slab.

24. The modular construction unit of claim 19, further comprising a pair of parallel deformed bar reinforcing metal rods extending horizontally within the ribs.

25. The modular construction unit of claim 19, wherein the insulating material filling the rectangular voids comprises generally rectangular blocks of insulating material.

26. The modular construction unit of claim 25, wherein the insulating material comprises rigid plastic foam.

27. The modular construction unit of claim 19, wherein the longitudinal beams are disposed spaced inwardly a predetermined distance from an outer peripheral edge of the stab thereby defining a cantilever region.

28. The modular construction unit of claim 19, wherein a transverse purlin is disposed coterminous with an outer peripheral edge of the slab.

29. The modular construction unit of claim 19, further comprising a plurality of support tubes embedded into corners of the slab and opening into the top surface of the slab for receiving vertical support members utilized in a modular building.

30. The modular construction unit of claim 29, wherein the support tubes are affixed to the steel channels.

31. The modular construction unit of claim 29, wherein the support tubes are affixed to the deformed bar reinforcing metal rods within a beam or purlin that extends to a corner of the slab.

32. The modular construction unit of claim 19, further comprising a plurality of wall support elements embedded into the top surface of the slab for providing means for attaching and securing side walls of a building to form a completed structure.

33. A modular construction unit for use as a floor or ceiling of a modular building, comprising:

a generally rectangular poured concrete slab with a planar top surface comprising:

a plurality of longitudinal beams extending downwardly from the bottom of the slab and integral with the slab, the longitudinal beams disposed spaced inwardly a predetermined distance from an outer peripheral edge of the slab thereby defining a cantilever region;

a plurality of transverse purlins extending downwardly from the bottom of the slab and integral with the slab, with a pair of said transverse purlins disposed coterminous with opposite outer peripheral edges of the slab;

the beams and purlins defining a plurality of rectangular voids on the underside of the slab;

rigid foam insulating material filling the rectangular voids and integral with the slab;

a plurality of ribs extending downwardly from the bottom of the slab, the downward extent of the ribs less than the downward extent of the beams and purlins, the ribs extending transversely and parallel to the purlins out to a peripheral edge of the slab;

an internal metal reinforcement matrix within the slab, comprising:

a plurality of deformed bar reinforcing metal rods extending horizontally within the beams, purlins, and ribs;

a plurality of continuous steel channels extending along the bottom edges of the beams and purlins;

a plurality of metal studs spaced at intervals and affixed to and extending upwardly from the channels into the beams and purlins, the metal studs including hooks at the upward ends thereof and extending into the concrete of the slab;

a metal wire grid embedded within an upper region of the slab;

a plurality of support tubes embedded into corners of the slab, affixed to the steel channels, and opening into the top surface of the slab for receiving vertical support members utilized in a modular building, the support tubes affixed to the deformed bar reinforcing metal rods within purlins that extends to the corners of the slab.

34. The modular construction unit of claim 33, further comprising wall support elements embedded into the top surface of the slab for attaching and securing side walls of a building to form a completed structure.

35. The modular construction unit of claim 33, wherein the ratio of the number of ribs to the number of purlins is greater than 7:1.

36. A modular construction unit for use as a floor or ceiling of a modular building, comprising:

a generally rectangular poured concrete slab with a planar top surface comprising:

a plurality of longitudinal beams extending downwardly from the bottom of the slab and integral with the slab;

a plurality of transverse purlins extending downwardly from the bottom of the slab and integral with the slab;

the beams and purlins defining a plurality of rectangular voids on the underside of the slab filled substantially with insulating material to form an integral unit with said slab;

a plurality of ribs extending downwardly from the bottom of the slabs, positioned between the purlins, the downward extent of the ribs less than the downward extent of the beams and purlins;

an internal metal reinforcement matrix within the slab, comprising:

deformed bar reinforcing metal extending horizontally within the beams and purlins;

a plurality of continuous steel channels extending along the bottom edges of the beams and purlins;

a metal wire grid embedded within an upper region of the slab; and a plurality of support tubes embedded into corners of the slab and opening into the top surface of the slab for receiving vertical support members utilized in a modular building.

37. The modular construction unit of claim 36, wherein the support tubes are affixed to the steel channels.

38. The modular construction unit of claim 36, wherein the support tubes are affixed to the deformed bar reinforcing metal within a beam or purlin that extends to a corner of the slab.

* * * * *